United States Patent [19]

Hudson

[11] 4,195,588

[45] Apr. 1, 1980

[54] REMOTE STEERING CONTROL FOR ELECTRIC OUTBOARD MOTORS

[76] Inventor: Donald E. Hudson, Rte. 15, Box 164, Lexington, N.C. 27292

[21] Appl. No.: 925,478

[22] Filed: Jul. 17, 1978

[51] Int. Cl.[2] ..... B63H 5/13; B63H 21/26

[52] U.S. Cl. ..... 115/18 E; 114/144 A; 115/35; 115/18 R

[58] Field of Search ..... 115/18 R, 18 E, 18 A, 115/134 R, 35; 280/266; 74/480 B, 493; 114/144 R, 114 RE, 114 A, 146, 153, 154–161

[56] References Cited

U.S. PATENT DOCUMENTS

| | | | |
|---|---|---|---|
| 2,775,950 | 1/1957 | Dearmond | 115/25 |
| 2,845,891 | 8/1958 | Frey | 115/18 R |
| 3,422,784 | 1/1969 | Becker | 114/146 |
| 3,602,181 | 8/1971 | Harris | 114/153 |
| 3,606,858 | 9/1971 | Edwards | 115/18 R |
| 4,143,436 | 3/1979 | Jones | 115/18 E |
| 4,151,807 | 5/1979 | Black | 115/18 R |

*Primary Examiner*—Charles E. Franfort

*Assistant Examiner*—D. W. Keen

[57] ABSTRACT

In outboard motors of the type in which an electric motor is encased in a housing submerged beneath the water surface and from which a rotatable steering shaft extends upwardly therefrom, which shaft is caused to rotate responsive to longitudinal motion of a Bowden wire or other type of horizontally moving force, there is provided an improved remote steering control for effecting longitudinal movement of the Bowden wire. The Bowden wire is connected at the free end thereof to an actuating arm extending outwardly from a seat pedestal or support shaft, so that rotation of the seat causes a responsive longitudinal movement or "stroke" of the Bowden wire to change the direction of movement of the boat. The plate or bracket upon which the seat is mounted is attached to the pedestal or support shaft by a slip clutch which permits control of the motor by rotation of the seat yet allows selective movement or adjustment of the direction in which the seat faces without a resulting change in direction of the boat when desired.

4 Claims, 4 Drawing Figures

REMOTE STEERING CONTROL FOR ELECTRIC OUTBOARD MOTORS

BACKGROUND OF THE INVENTION

In recent years, there have been developed electric motors or other very small motors which are mounted at the front of a fishing boat for maneuvering the boat slowly around lakes and ponds. As far as applicant has been able to determine the only control mechanism for such types of motors is a foot pedal operated by the occupant of the front seat which, when activated, causes longitudinal movement of a Bowden wire causing a rotation of the steering shaft which suspends the small motor from the front end of the boat. In order to turn the boat in one direction, the pedal is depressed at the front end while a depression of the rear end causes the boat to turn in the other direction. The problem with such a control apparatus is that often the occupant may wish to fish facing other than straight out the front of the boat. In such cases then, as he turns his seat sideways, he must reach down and manually relocate the foot pedal to a position near the side of the boat where he can control the steering of the boat. This is quite cumbersome in that it constantly requires movement of the foot pedal around in the bottom of the boat. Examples of such foot pedal controlled steering mechanisms are described and illustrated in U.S. Pat. Nos. 3,602,181 and 3,606,858.

There are also known in the prior art steering devices for other types of boat motors in which the direction of the boat may be controlled to some degree in response to a rotation of a seat by its occupant, which in turn causes a resulting rotation of the propeller shaft of the motor. Examples of such seat controlled steering devices are described and illustrated in U.S. Pat. Nos. 2,775,950 and 2,845,891. However, in each of these devices, and in all other seat controlled steering devices known to applicant, the seat may not be moved independently of the steering mechanism so that the occupant must always face in a direction corresponding to the direction in which the boat is either moving or turning. In other words, in these devices, it is impossible for the occupant of the seat which controls the steering mechanism to sit facing either side of the boat while the boat itself travels in a forwardly direction. Also, it is impossible for the occupant to sit facing toward the right hand side of the boat while causing the boat to actually turn toward the left. In achieving full utilization of a bass fishing boat or other type of fishing boat, this feature is most desirable. It also may even be desirable for the occupant to be able to control the direction of movement of the boat while in a standing position.

SUMMARY OF THE PRESENT INVENTION

The present invention, on the other hand, is directed to a remote steering control for electric boat motors in which the steerage of the boat is controlled by a body turn of the occupant of the forward boat seat. Thus the steering shaft on which the motor and propeller are mounted is connected to the seat pedestal in such a manner that a rotation of the seat generally causes a rotation of the motor shaft. However, in contradistinction to the other types of seat controlled steering apparatuses, the seat is connected to the pedestal by means of a slip clutch design which allows the seat to be turned to face any direction desired by the occupant, and yet still be able to steer the boat in any direction desirable, whether the occupant is facing to either side or straight ahead. Generally in accordance with a preferred embodiment the weight of the occupant engages the opposed faces of the clutch to cause turning of the pedestal responsive to turning of the occupant's body; however, this slip clutch means may be overcome by simply rotating the body and seat past the point where the pedestal engages a stop. Alternatively, a locking means may maintain the faces of the slip clutch in engaged relation when the seat is unoccupied, wherein the fisherman may stand up and control the boat with his leg or knee by moving the seat in a rotational direction.

Toward this end, the steering control apparatus of the present invention includes a seat pedestal which in turn includes a seat mounting bracket and a support shaft on which the seat is mounted into a well in the bottom of the boat. An actuating arm is secured to the support shaft and extends horizontally therefrom. The free end of the actuating arm receives and secures one end of a Bowden wire, the other end of which is attached to the steering mechanism of the motor, the wire itself, forming no part of the present invention. Therefore, when the Bowden wire is moved longitudinally responsive to rotation of the seat support shaft, the motor shaft is caused to turn also.

A slip clutch means connects the seat mounting bracket to the upper end of the support shaft for allowing both selected rotational movement of both the seat mounting bracket and the support shaft and positioning of the seat mounting bracket in a direction desired independently of the rotational position of the support shaft.

When the seat is unoccupied, a locking arm may be activated to secure the seat support shaft and the seat mounting bracket together to prohibit relative slippage of the seat bracket with respect to the support shaft. This allows control of the seat even if unoccupied, even though normally the weight of the occupant will link the seat bracket to the support shaft for corresponding rotational movement therewith.

It is therefore an object of the present invention to provide an improved remote steering control apparatus for boats equipped with electric motors.

It is another object of the present invention to provide an improved remote steering apparatus in which the direction of movement of boats equipped with electric motors may be controlled by a rotational body movement of the occupant in his seat.

It is yet a further object of the present invention to provide a remote steering apparatus of the type described in which a slip clutch means connects the boat seat with the seat support shaft, so that the seat may be positioned to face any desired direction without causing a corresponding shift of direction in the movement of the boat.

Other objects and a fuller understanding of the invention will become apparent upon reading the following detailed description of a preferred embodiment in which.

DETAILED DESCRIPTION OF A PREFERRED EMBODIMENT

Figure 1:
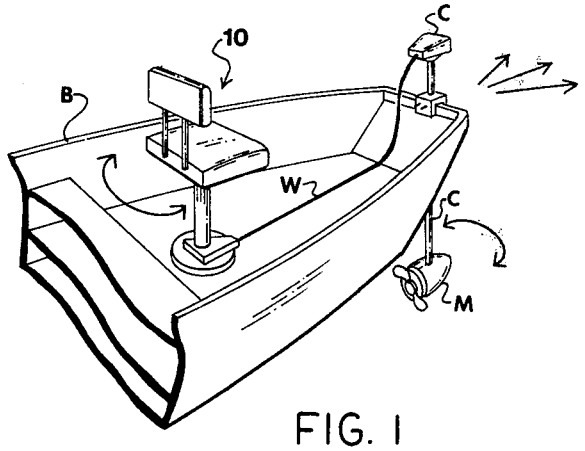
FIG. 1 is a partial perspective view illustrating the front end of a boat having an electric motor of the type for which the present invention is designed to control.

Turning now to the drawings, there is illustrated in FIG. 1 a small fishing boat B of the type generally used for slowly moving around ponds and lakes, and usually referred to as a fishing boat. Such boats are conventionally equipped with small electric motors M which are suspended from the front end of the boat B by means of a support shaft S. A control housing C includes some type of rotational inducing mechanism which is operated responsive to a linear actuator to rotate shaft S to steer or turn the boat from side to side. Such types of rotational inducing mechanisms are illustrated by the Edwards U.S. Pat. No. 3,606,858 and the Harris U.S. Pat. No. 3,602,181. The housing includes a Bowden wire W extending therefrom into the interior of the boat. A longitudinal movement of the Bowden wire W will cause a resulting rotation of the motor. Conventionally, the Bowden wires have been controlled by a linear actuator such as a foot pedal as illustrated in the two patents referred to hereinabove. The interior of the control housing C is conventional and forms no part of the present invention. Rather, the present invention is directed to the actuator means by which the Bowden wire W is operated.

In this regard, according to the present invention when the seat 10 is rotated, the seat is so interconnected to the free end of the Bowden wire W as to cause the Bowden wire to move longitudinally, thus controlling the rotational positioning of motor M.

Figure 2:
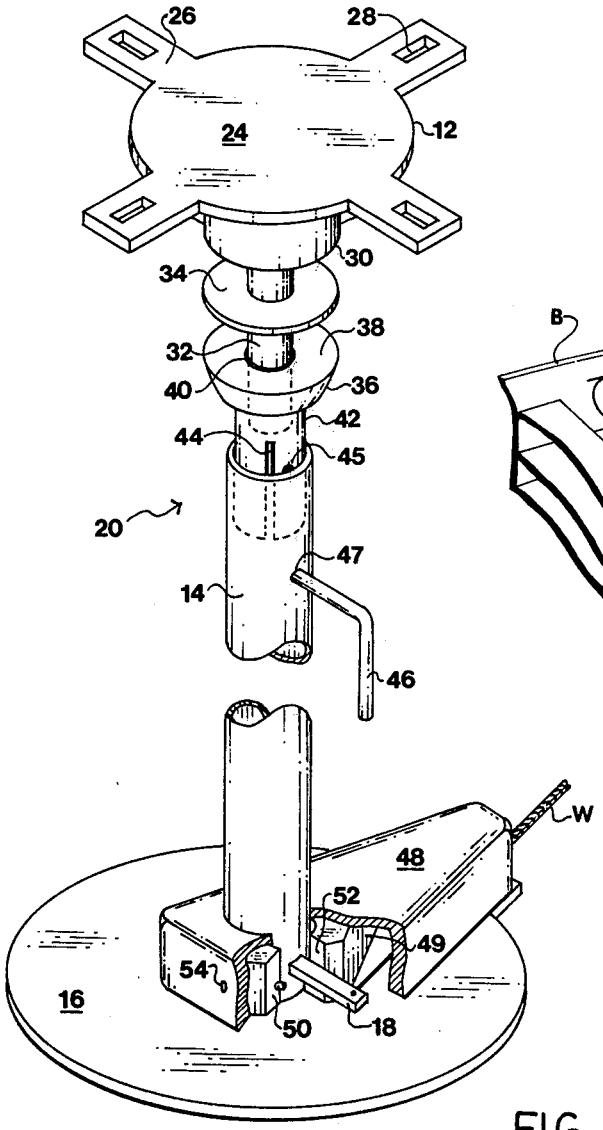
FIG. 2 is a partially exploded perspective view of the seat pedestal according to the present invention, with parts broken away for the sake of clarity.
Figure 3:
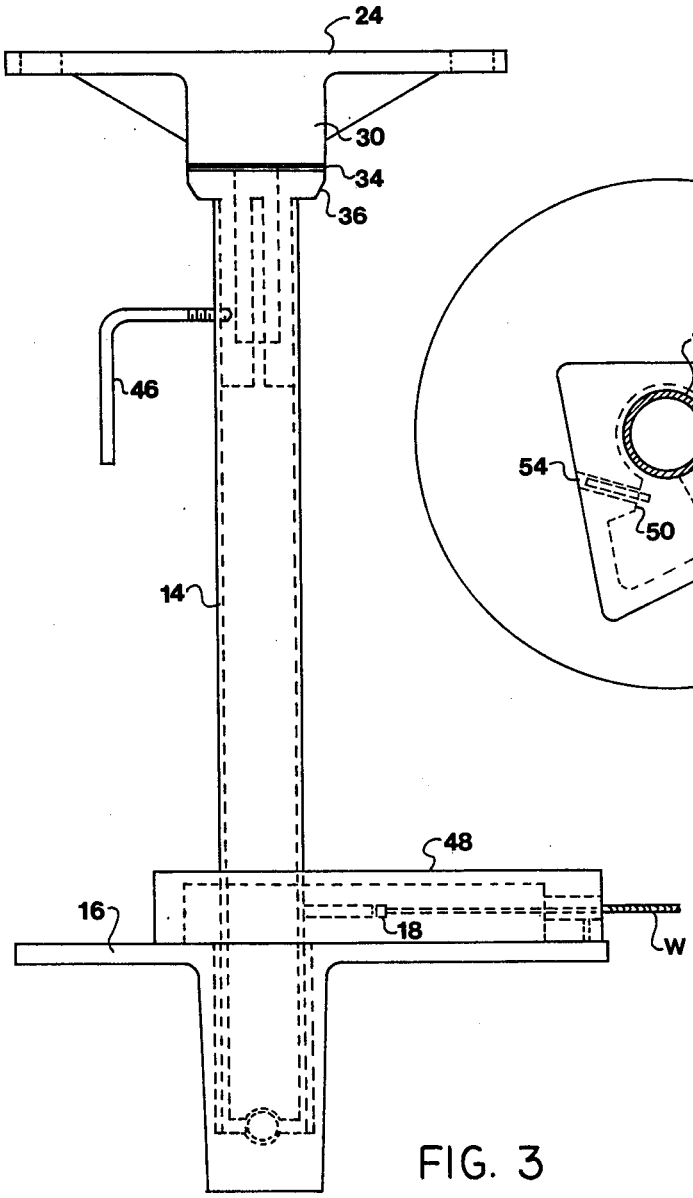
FIG. 3 is a side elevation view of the seat pedestal according to the present invention.
Figure 4:
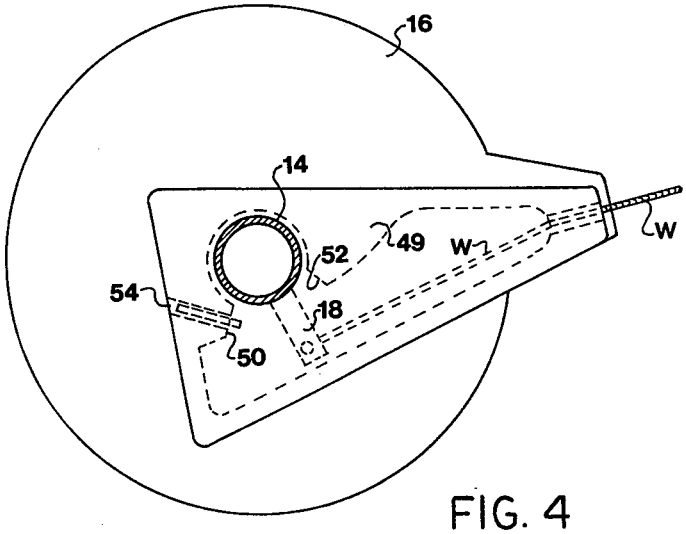
FIG. 4 is a plan view of the pedestal base illustrating the actuating arm connected to one end of a Bowden wire.

Turning now to FIGS. 2–4, there is better illustrated enlarged views of the seat 10 as constructed in accordance with the present invention. Basically, the seat includes a seat mounting bracket 12, a mounting pedestal 14, a base 16, an actuating arm 18 secured to the rotating pedestal 14 and receiving one end (free end) of the Bowden wire W, and a slip clutch means 20 connecting the seat bracket 12 with the pedestal 14.

More specifically, the mounting seat bracket 12 includes a central, circular web portion 24 having a plurality of arms or ears 26 extending outwardly therefrom, each of which includes a slot 28 therein onto which the seat 10 is mounted in a suitable fashion. A central hub 30 extends downwardly from the underneath side of the central web portion 24 and includes a mounting rod 32 of reduced diameter depending axially therefrom. An annular shaped slip washer 34 formed of rubber, cork, plastic, or other synthetic resilient material is mounted on rod 32 for reasons to be described hereinafter.

The slip clutch means 20 includes a split collar 36 having an upper annular portion 38 with a central opening 40 therein of such size and shape as to receive the depending shaft 32 from the bracket 12. A depending cylindrical member 42 extends downwardly from the upper annular portion 38 and includes a plurality of axially extending slits 44 therein. An indention 45 is in the outer wall of cylindrical member 42 for reasons to be described herebelow.

A locking arm 46 is provided through an opening 47 in the wall of the pedestal 14, which brings the end of the locking arm 46 into engagement with the indention 45 in collar 36. Upon turning motion of the arm 46, first of all relative motion between the collar 36 and pedestal 14 is prevented. Upon further movement of locking arm 46 the split collar 36 is caused to squeeze against the shaft 32, thereby locking the seat bracket 12 to the pedestal 14 so that rotation of the seat causes a resulting rotation of the pedestal. During occupancy, the weight of the occupant on seat 10 pushes the hub 30 into sufficient engagement with the resilient washer 34 as to cause rotation of the pedestal 14 when the seat is turned, until one of the stops 50,52 is engaged by arm 18 as will be described hereinafter. Thereafter, continued motion of the occupant in turning the seat is still permitted, however, no further turning of the pedestal will occur because of the engagement of arm 18 with one of the abutments 50,52.

The Bowden wire W is attached to activating arm 18 inside a housing 48 which receives the pedestal 14 in rotative relationship therein. Housing 48 includes a stationary disc member 49 which includes a slotted portion therein having a pair of spaced abutments 50,52. These abutments limit the movement of the arm throughout a prescribed arc as is determined by the movement of Bowden wire W necessary to cause a 360° rotation of the motor shaft S. In order to further limit movement of the activating arm 18 for whatever reason may be necessary, a set screw 54 is provided through abutment 50 and may be turned inwardly to provide an auxiliary stop position, so that the movement of arm 18 is limited more than would be the case if the abutment surface 50 were used.

Control mechanism C generally known in the industry is such that a stroke of one-two inches of the Bowden wire will generally cause a 360° rotation of the shaft S. In the illustrated preferred embodiment there is provided sufficient arcuate gap between abutments 50,52 to provide sufficient movement of the arm 18 to apply a maximum stroke to the Bowden wire.

Therefore, an occupant of seat 10, generally fishing straight ahead, can control the boat by making slight body movements to one side or the other. A movement of 26° will cause a motor shaft to rotate 360° . The weight of the occupant upon the slip clutch means 20 will cause sufficient frictional engagement between the hub 30 and the split collar 36 to transfer rotational movement of the occupant's body to the rotating pedestal 14. However, it frequently occurs that the occupant of seat 10 may want to fish out the sides of the boat, either the left or the right. In such a case, the occupant merely turns his seat 90°, and when the arm 18 engages one of abutments 50 or 52 rotation of pedestal 14 ceases; however, the resilient ring 34 will allow the seat to continue its movement even though the pedestal 14 is stopped. The occupant then merely moves his seat in an arc past the point facing in the direction in which he wants to fish a number of degrees sufficient that when he brings the seat back to its desired position, the arm 18 is centrally positioned between the abutments 50,52 in such a manner that the motor M is pointed straight ahead. Then continued movement left or right by the occupant's body will continue to steer the boat as is deemed necessary.

One other condition needs to be mentioned and that is when the occupant desires to stand up and fish. In such a case the locking arm 46 is tightened against the split collar 36 until the walls of the cylindrical portion 42 are pinched in against shaft 32. There can then be no relative slippage between the seat bracket 12 and the pedestal 14. So situated, when the occupant of the boat causes a rotation of the seat as with his leg or knee, the pedestal 14 will turn and steering of the boat will thus be effected.

Although a preferred embodiment of the invention has been described in detail hereinabove, it is obvious that various changes and modifications might be made without departing from the scope of the invention which is set forth in the claims below.

What is claimed is:

1. Remote steering control for electric outboard motors of the type wherein the outboard motor casing includes a rotatable steering shaft extending upwardly therefrom which is caused to rotate responsive to longitudinal movement of a Bowden wire or the like, said steering control comprising:

(a) a seat pedestal including a support shaft having a seat mounting bracket supported on the upper end thereof;

(b) an actuating arm secured to said support shaft and extending horizontally therefrom, the free end of said arm receiving and securing one end of said Bowden wire so that said Bowden wire is moved longitudinally responsive to rotation of said support shaft;

(c) slip clutch means connecting said seat mounting bracket to the upper end of said pedestal support shaft for allowing both selected rotational movement of said support shaft and positioning of said seat mounting bracket independently of said support shaft.

2. The remote steering control according to claim 1 wherein said slip clutch means comprises a split collar received within the upper end of said support shaft, means for selectively maintaining said collar in non-rotative relation to said support shaft, said collar having a central opening surrounded by a cylindrical wall, a support rod extending downwardly from said seat mounting bracket and received within said central opening, and a slip washer formed of a resilient material interposed between the opposed surfaces of said mounting bracket and said collar, whereby rotation of said seat bracket with an occupant seated in the seat thereof will cause a resulting rotation of said steering shaft, while rotation of said seat bracket without an occupant will normally not affect steerage of the boat.

3. The remote steering control according to claim 2 wherein a pair of spaced stops are positioned in the path of said actuating arm limiting movement of said support shaft and arm in either direction, yet said slip clutch means permits continued rotation of said seat mounting bracket even after engagement of one of said stops halts rotation of the seat pedestal.

4. The remote steering control according to claim 3 and further including a locking means selectively operable to lock said split collar and said seat mounting bracket support rod for preventing relative movement of said seat bracket and said pedestal whereby the boat may be steered even when the seat is unoccupied and no weight is brought to bear on said mounting bracket.

* * * * *